US011619066B2

(12) United States Patent
Bennett et al.

(10) Patent No.: US 11,619,066 B2
(45) Date of Patent: Apr. 4, 2023

(54) ARM-RECEIVING DOOR HANDLE ASSEMBLY, SLIDING LOCK ASSEMBLY, AND SYSTEM THEREOF

(71) Applicant: Triangle Brass Manufacturing Co., Inc., Oceanside, CA (US)

(72) Inventors: Jason Bennett, San Marcos, CA (US); Curtis Patrick Odom, Vista, CA (US)

(73) Assignee: Triangle Brass Manufacturing Co., Inc., Oceanside, CA (US)

( * ) Notice: Subject to any disclaimer, the term of this patent is extended or adjusted under 35 U.S.C. 154(b) by 288 days.

(21) Appl. No.: 17/018,000

(22) Filed: Sep. 11, 2020

(65) Prior Publication Data

US 2022/0081931 A1 Mar. 17, 2022

(51) Int. Cl.
*E05B 1/00* (2006.01)
*E05B 3/04* (2006.01)

(52) U.S. Cl.
CPC ..... *E05B 1/0053* (2013.01); *E05B 1/0061* (2013.01); *E05B 1/0069* (2013.01); *E05B 3/04* (2013.01)

(58) Field of Classification Search
CPC ..... E05B 1/00; E05B 1/0007; E05B 1/0038; E05B 1/0053; E05B 1/0061; E05B 1/0069; E05B 3/00; E05B 3/02; E05B 3/04; E05B 3/10; E05B 3/003; E05B 13/00; E05B 13/105; E05B 53/00; E05B 53/001; E05B 5/00; E05B 7/00; E05B 79/00; E05B 79/06
USPC ..... 292/336.3
See application file for complete search history.

(56) References Cited

U.S. PATENT DOCUMENTS 8,720,116 B1 * 5/2014 Ahmad ..... E05B 17/2038 16/431
9,394,732 B1 * 7/2016 Ahmad ..... E05B 1/0046
2016/0130846 A1 * 5/2016 Shah ..... E05C 1/14 292/138
2017/0284125 A1 * 10/2017 Shah ..... E05C 1/14

* cited by examiner

*Primary Examiner* — Nathan Cumar
(74) *Attorney, Agent, or Firm* — The Iwashko Law Firm, PLLC; Lev Ivan Gabriel Iwashko

(57) ABSTRACT

An arm-receiving door handle and sliding lock system, including an arm-receiving door handle assembly, including an interior plate removably connected to at least a portion of an inner surface of a door to receive a limb of a user thereon, and an exterior plate removably connected to at least a portion of an exterior surface of the door, and a sliding lock assembly, including a knob assembly removably connected to the interior plate to move laterally from unlocked in a first position to at least partially locked in a second position, and from locked in the second position to at least partially unlocked in the first position, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position.

20 Claims, 11 Drawing Sheets

1210

1210

ARM-RECEIVING DOOR HANDLE ASSEMBLY, SLIDING LOCK ASSEMBLY, AND SYSTEM THEREOF

BACKGROUND

1. Field

The present general inventive concept relates to an arm-receiving door handle assembly, a sliding lock assembly, and system thereof.

2. Description of the Related Art

Conventional doors use a door knob and/or a door handle to facilitate opening thereof. More specifically, the door knob and/or the door handle are mounted on a door using a tumbler disposed in the door and a latch assembly. Additionally, the tumbler rotates in response to rotation of the door knob and/or the door knob, such that the latch assembly moves within the door and away from a door strike. As such, the door may be opened after the latch assembly moves away from the door strike.

However, the door knob and/or the door handle rely on contact by hands of a user. In other words, the door knob and/or the door handle are moved using the hands of the user. Unfortunately, hands of a person are often unsanitary due to numerous surfaces and/or objects that may be touched over the course of a day. The constant contact with surfaces and/or objects may result in transmission of a wide variety of pathogens and/or harmful contaminants that can be harmful to people who unwittingly expose the pathogens and/or the harmful contaminants to each other.

Also, the conventional doors include conventional locks, such as doorknob locks, deadbolts, barrel bolts, chain locks, cam locks, padlocks, and electronic locks. Similar to the door knob and/or the door handle, the conventional locks require touch by the hands of the user either directly and/or indirectly (e.g., smartphone control of the electronic locks).

Recent solutions include automatic doors that use motion sensors and/or pressure sensors. The automatic doors may open and/or close the automatic doors in response to detection of motion and/or pressure of the user in proximity to the automatic doors. Accordingly, the automatic doors prevent the user from ever touching a portion of the automatic doors, and exposure to the pathogens and/or the harmful contaminants is avoided.

The automatic doors are generally found at entrances and/or exits of commercial buildings. As such, even if the automatic doors are used by the commercial buildings, the conventional doors are still used within an interior of the commercial buildings.

Therefore, there is a need for a door handle that allows the user open and/or close the door without using the hands of the user to move the door handle.

Furthermore, there is a need for a door lock that can be moved without using the hands of the user to move the door lock.

SUMMARY

The present general inventive concept provides an arm-receiving door handle assembly, a sliding lock assembly, and system thereof.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an arm-receiving door handle and sliding lock system, including an arm-receiving door handle assembly, including an interior plate removably connected to at least a portion of an inner surface of a door to receive a limb of a user thereon, and an exterior plate removably connected to at least a portion of an exterior surface of the door, and a sliding lock assembly, including a knob assembly removably connected to the interior plate to move laterally from unlocked in a first position to at least partially locked in a second position, and from locked in the second position to at least partially unlocked in the first position, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position.

The interior plate may include a lateral surface, a first curved portion arcuately disposed away from a first end of the lateral surface with respect to a direction to facilitate gripping thereof, and a second curved portion arcuately disposed away from a second end of the lateral surface with respect to the direction to facilitate gripping thereof.

The first curved portion and the second curved portion may curve toward a center of the lateral surface.

The interior plate may include a lock receiving aperture disposed on at least a portion of the interior plate to receive the knob assembly therethrough.

The knob assembly may include a main body, a knob disposed on at least a portion of the main body to facilitate gripping thereof, a surface cover connected to the main body to receive the main body therethrough, a first shim connected to the surface cover to facilitate movement of the main body and the surface cover against the interior plate, a second shim connected to the interior plate to receive the main body therethrough, and a retaining ring removably connected to the main body to prevent the main body from moving away from the interior plate.

The carrier may include a body, a lock connecting aperture disposed on and within at least a portion of a center portion of the body to receive the knob assembly therethrough, a first elevated portion disposed on at least a portion of a front portion of the body, a second elevated portion disposed on at least a portion of the front portion of the body, such that the center portion of the body is recessed with respect to the first elevated portion and the second elevated portion, and a bolt receiving aperture disposed on and within at least a portion of the body to receive the bolt therein.

The bolt may include a body, at least one knob receiving aperture disposed on at least a portion of the body to receive the knob assembly therein, and at least one detent ball aperture disposed on at least a portion of the body.

The arm-receiving door handle and sliding lock system may further include a detent ball connected to at least a portion of the carrier and the at least one detent ball aperture to increase resistance to movement of the knob assembly in at least one of the first position and the second position.

The arm-receiving door handle and sliding lock system may further include an indicator plate to receive a plurality of indicators thereon to indicate at least one of the first position and the second position of the knob assembly.

The exterior plate may include a main surface, and an indicator aperture disposed on at least a portion of the main surface to display the indicator plate therethrough.

The exterior plate may further include an emergency release slot disposed on at least a portion of the main surface to receive a release tool therethrough, such that the bolt connects to the release tool and moves in response to movement of the release tool.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1B:
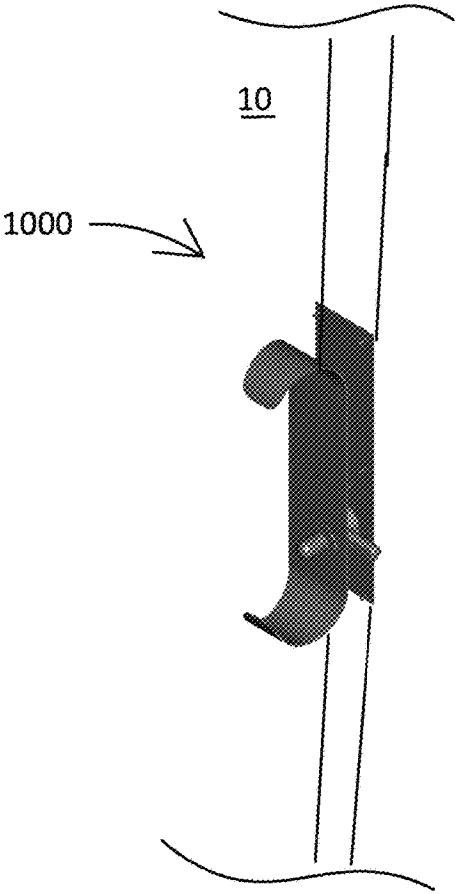
FIG. 1B illustrates a front perspective view of the arm-receiving door handle assembly and the sliding lock assembly, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Arm-Receiving Door Handle and Sliding Lock System 1000
Arm-Receiving Door Handle Assembly 1100
Interior Plate 1110
Lateral Surface 1111
First Curved Portion 1112
Second Curved Portion 1113
Lock Receiving Aperture 1114
Wood Fastener Receiving Apertures 1115
Wood Fasteners 1116
Weld Studs 1117
Fastener Receiving Aperture 1117*a*
Exterior Plate 1120
Main Surface 1121
Indicator Aperture 1122
Set Fastener Receiving Apertures 1123
Set Fasteners 1124
Wood Fastener Receiving Apertures 1125
Wood Fasteners 1126
Emergency Release Slot 1127
Sliding Lock Assembly 1200
Knob Assembly 1210
Main Body 1211
Cylindrical Surface 1211*a*
Ring Receiving Groove 1211*b*
Bolt Connecting Portion 1211*c*
Knurled Surface 1211*d*
Knob 1212
Surface Cover 1213
Body 1213*a*
Center Aperture 1213*b*
First Shim 1214
First Body 1214*a*
First Aperture 1214*b*
Second Shim 1215
Second Body 1215*a*
Second Aperture 1215*b*
Retaining Ring 1216
Ring Body 1216*a*
Ring Aperture 1216*b*
Ring Gap 1216*c*
Detent Ball 1220
Threaded Portion 1221
Rounded Surface 1222
Smooth Portion 1223
Carrier 1230
Body 1231
Lock Connecting Aperture 1232
First Elevated Portion 1233
First Stud Receiving Aperture 1234
Second Elevated Portion 1235
Second Stud Receiving Aperture 1236
Bolt Receiving Aperture 1237
Bolt 1240
Body 1241
First Knob Receiving Aperture 1242
Second Knob Receiving Aperture 1243
First Detent Ball Aperture 1244
Second Detent Ball Aperture 1245
Indicator Plate 1250
Body 1251
First Elevated Portion 1252
Second Elevated Portion 1253
Indented Portion 1254
Knob Receiving Aperture 1255
Indicators 1260

Figure 1A:
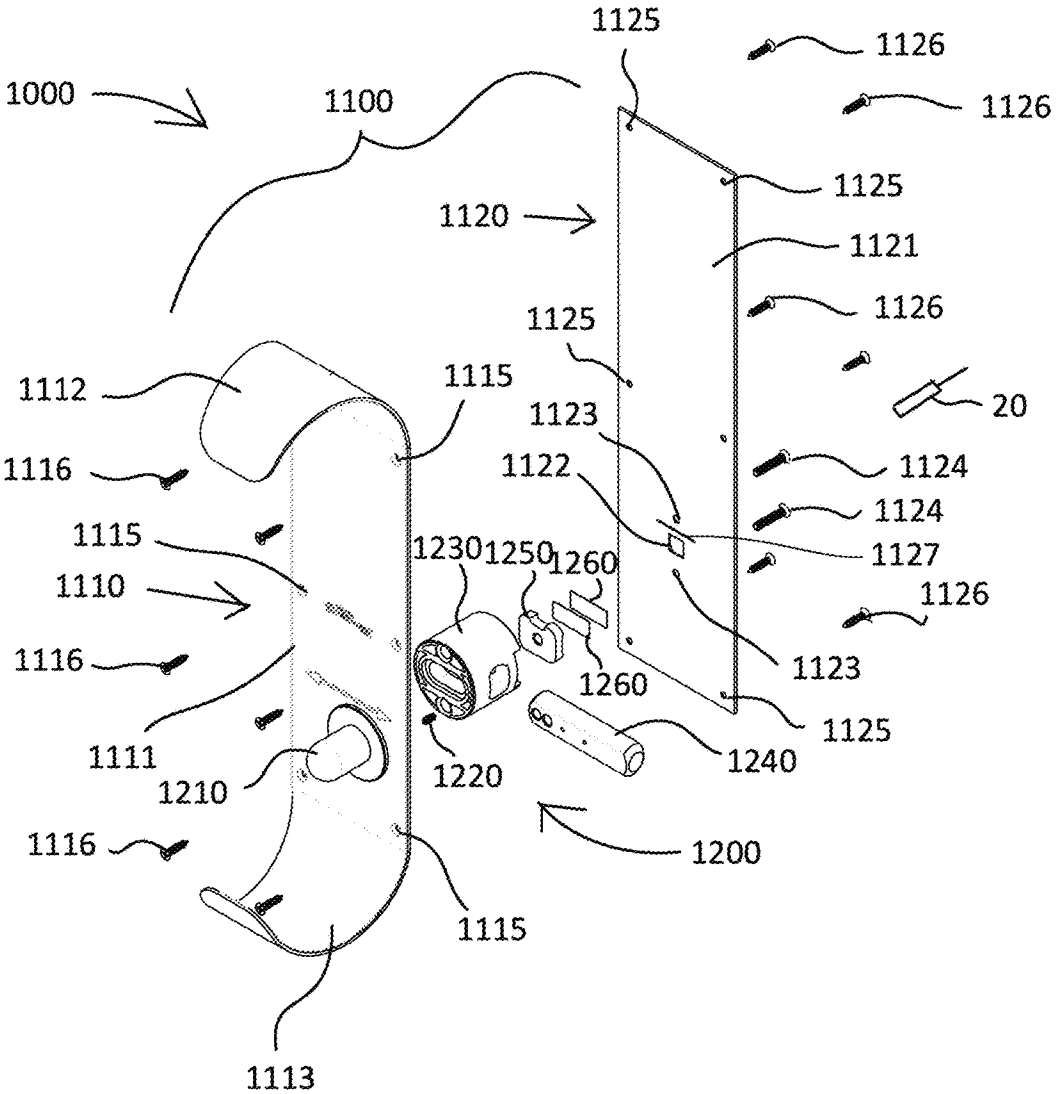
FIG. 1A illustrates an exploded view of an arm-receiving door handle assembly and a sliding lock assembly, according to an exemplary embodiment of the present general inventive concept.

FIG. 1A illustrates an exploded view of an arm-receiving door handle assembly 1100 and a sliding lock assembly 1200, according to an exemplary embodiment of the present general inventive concept.

FIG. 1B illustrates a front perspective view of the arm-receiving door handle assembly 1100 and the sliding lock assembly 1200, according to an exemplary embodiment of the present general inventive concept.

The arm-receiving door handle and sliding lock system 1000 may be constructed from at least one of metal, plastic, wood, ceramic, and rubber, etc., but is not limited thereto.

The arm-receiving door handle and sliding lock system 1000 may include an arm-receiving door handle assembly 1100 and a sliding lock assembly 1200, but is not limited thereto.

Figure 2B:
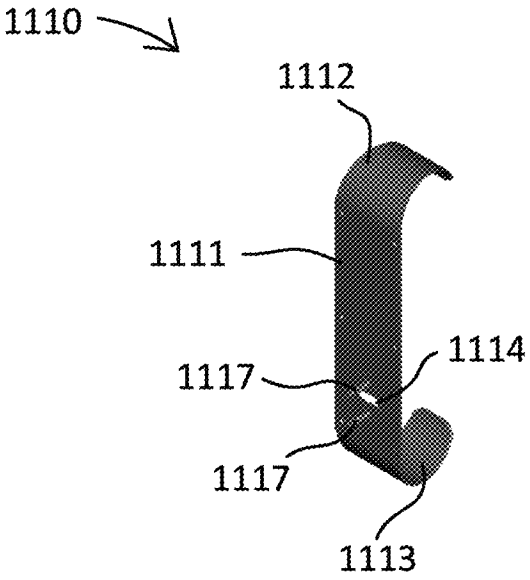
FIG. 2B illustrates a rear perspective view of the interior plate, according to an exemplary embodiment of the present general inventive concept.
Figure 2A:
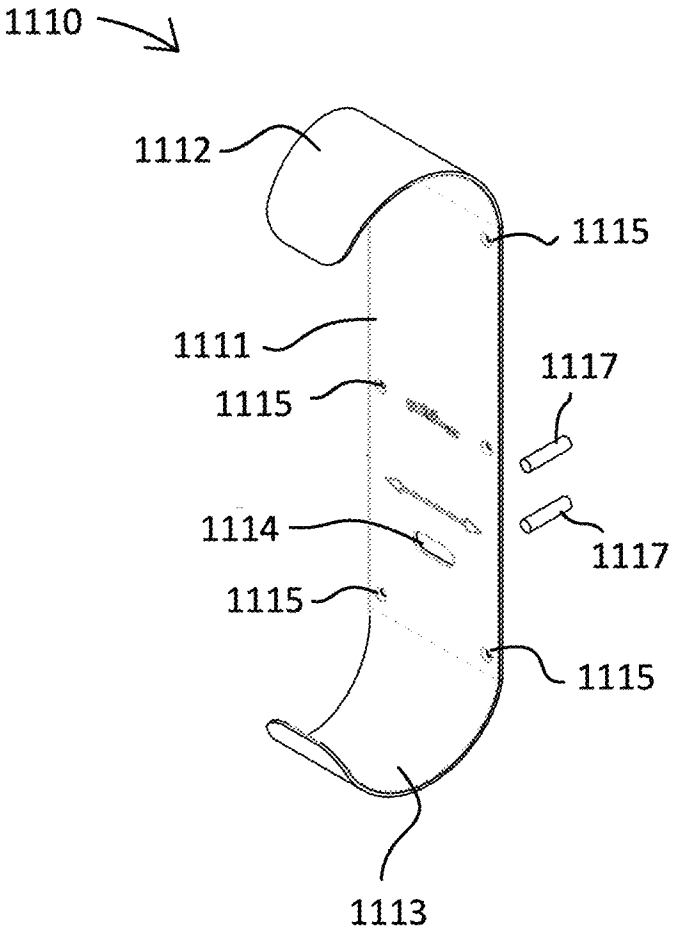
FIG. 2A illustrates a front perspective view of an interior plate, according to an exemplary embodiment of the present general inventive concept.

FIG. 2A illustrates a front perspective view of an interior plate 1110, according to an exemplary embodiment of the present general inventive concept.

FIG. 2B illustrates a rear perspective view of the interior plate 1110, according to an exemplary embodiment of the present general inventive concept.

Figure 2C:
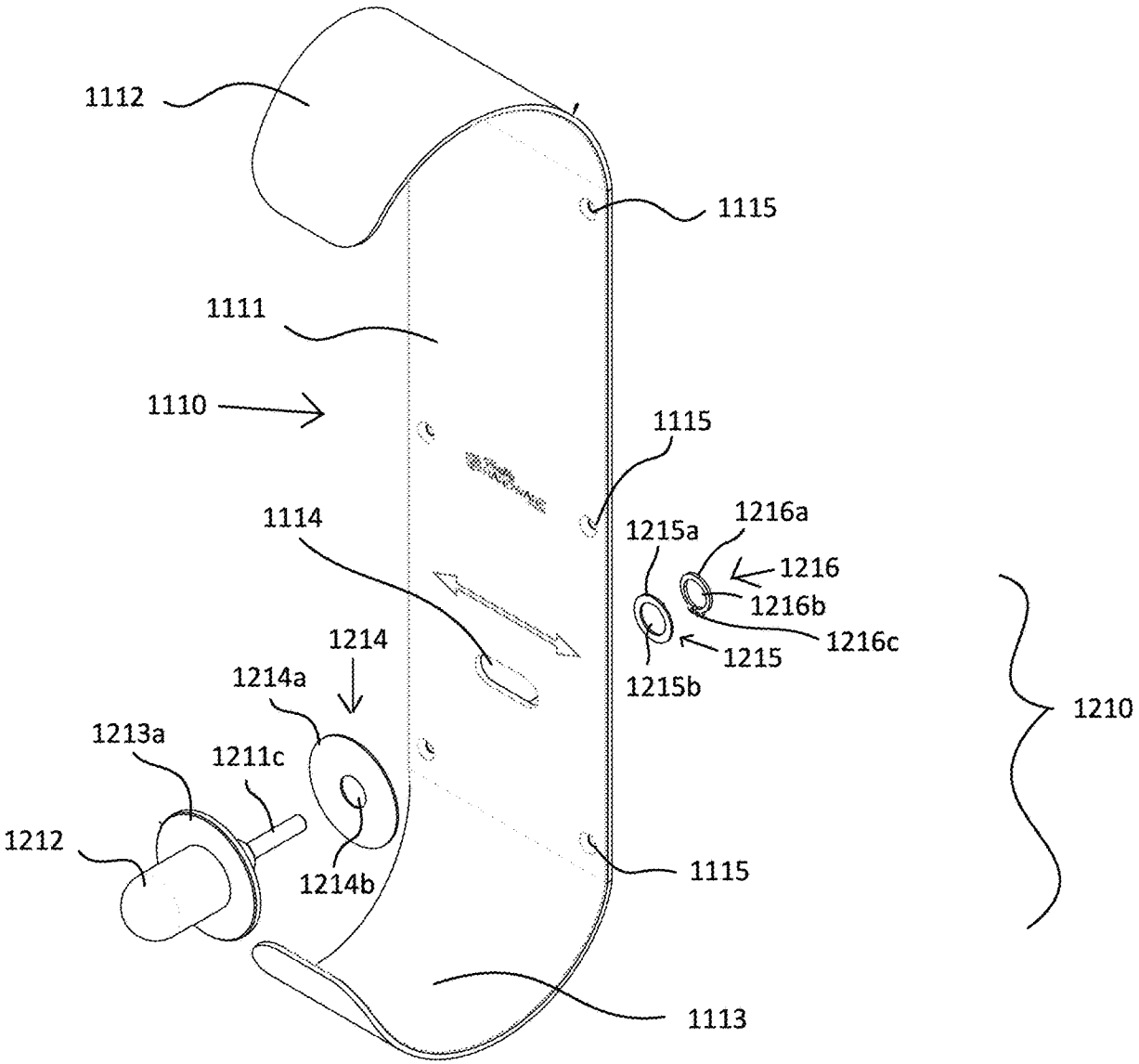
FIG. 2C illustrates a front perspective view of the interior plate and an exploded view of a knob assembly, according to an exemplary embodiment of the present general inventive concept.

FIG. 2C illustrates a front perspective view of the interior plate 1110 and an exploded view of a knob assembly 1210, according to an exemplary embodiment of the present general inventive concept.

Figure 2D:
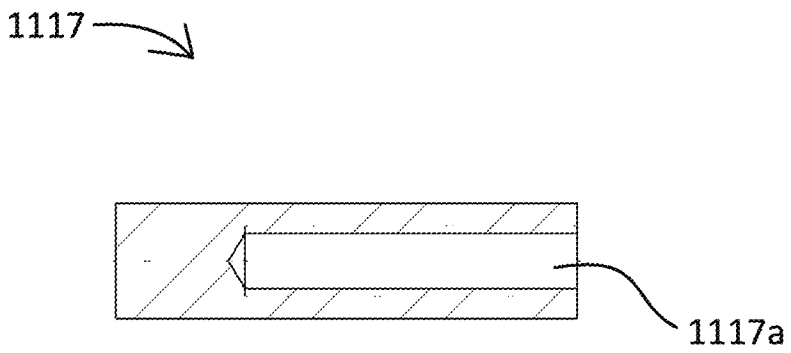
FIG. 2D illustrates a sectional view of a weld stud, according to an exemplary embodiment of the present general inventive concept.

FIG. 2D illustrates a sectional view of a weld stud 1117, according to an exemplary embodiment of the present general inventive concept.

Referring to FIGS. 1A through 2D, the arm-receiving door handle assembly 1100 may include an interior plate 1110 and an exterior plate 1120, but is not limited thereto.

The interior plate 1110 may include a lateral surface 1111, a first curved portion 1112, a second curved portion 1113, a lock receiving aperture 1114, a plurality of wood fastener receiving apertures 1115, a plurality of wood fasteners 1116, and a plurality of weld studs 1117, but is not limited thereto.

The lateral surface 1111 may be removably connected to at least a portion of a door 10. For example, the lateral surface 1111 may be removably connected to an inner surface of the door 10. Additionally, the lateral surface 1111 may be retrofit to the door 10, such that the lateral surface 1111 may replace any existing door handle and/or door lock combination.

The first curved portion 1112 may be arcuately disposed away from a first end of the lateral surface 1111 with respect to a direction. Similarly, the second curved portion 1113 may be arcuately disposed away from a second end of the lateral surface 1111 with respect to the direction. However, the first curved portion 1112 may be arcuately disposed different from and opposite with respect to the second curved portion 1113. More specifically, the first curved portion 1112 may curve toward the second end of the lateral surface 1111, and the second curved portion 1113 may curve toward the first end of the lateral surface 1111. As such, the first curved portion 1112 and/or the second curved portion 1113 may curve toward a center of the lateral surface 1111.

Also, the first curved portion 1112 and/or the second curved portion 1113 may be tapered, such that a width of the first curved portion 1112 and/or a width of the second curved portion 1113 may be less than a width of the lateral surface 1111.

The first curved portion 1112 and/or the second curved portion 1113 may receive a limb of the user therein. For example, the first curved portion 1112 and/or the second curved portion 1113 may receive an arm, a wrist, an elbow, a shoulder, a leg, and/or a knee of the user therein. As such, the first curved portion 1112 and/or the second curved portion 1113 may facilitate gripping thereof, such that hands of the user are not needed.

The lock receiving aperture 1114 may be disposed on at least a portion of the lateral surface 1111, such that a first distance of the lock receiving aperture 1114 from the first end of the lateral surface 1111 is greater than a second distance of the lock receiving aperture 1114 from the second end of the lateral surface 1111.

Referring to FIG. 2A, the lock receiving aperture 1114 is illustrated to have an oval shape. However, the lock receiving aperture 1114 may be rectangular, triangular, pentagonal, hexagonal, heptagonal, octagonal, and any other shape known to one of ordinary skill in the art.

The plurality of wood fastener receiving apertures 1115 may be disposed on at least a portion of the lateral surface 1111, such as along each edge and/or each corner of the lateral surface 1111. However, the plurality of wood fastener receiving apertures 1115 may be disposed at any feasible location.

Each of the plurality of wood fasteners 1116 may include a screw, a bolt, a nail, a washer, a clasp, a magnet, an adhesive, and any combination thereof, but is not limited thereto.

Each of the plurality of wood fasteners 1116 may be removably inserted through at least one of the plurality of wood fastener receiving apertures 1115 to connect the lateral surface 1111 to an exterior surface, such as the door 10.

Each of the plurality of weld studs 1117 may include a fastener receiving aperture 1117*a*, but is not limited thereto.

Referring to FIGS. 2A and 2B, the plurality of weld studs 1117 may be disposed on at least a portion of a rear surface of the lateral surface 1111.

The exterior plate 1120 may include a main surface 1121, an indicator aperture 1122, a plurality of set fastener receiving apertures 1123, a plurality of set fasteners 1124, a plurality of wood fastener receiving apertures 1125, a plurality of wood fasteners 1126, and an emergency release slot 1127, but is not limited thereto.

The main surface 1121 may be removably connected to at least a portion of the door 10. For example, the main surface 1121 may be removably connected to an outer surface of the door 10 opposite with respect to the inner surface. Additionally, the main surface 1121 may be retrofit to the door 10, such that the main surface 1121 may replace any existing door handle and/or door lock combination.

The indicator aperture 1122 may be disposed on at least a portion of the main surface 1121, such that a first distance of the indicator aperture 1122 from a first end of the main surface 1121 is greater than a second distance of the indicator aperture 1122 from a second end of the main surface 1121.

Referring to FIG. 1A, the indicator aperture 1122 is illustrated to have a square shape. However, the indicator aperture 1122 may be rectangular, triangular, pentagonal, hexagonal, heptagonal, octagonal, and any other shape known to one of ordinary skill in the art.

The plurality of set fastener receiving apertures 1123 may be disposed on at least a portion of the main surface 1121, such as adjacent to the indicator aperture 1122. However, the plurality of set fastener receiving apertures 1123 may be disposed at any feasible location.

Each of the plurality of set fasteners 1124 may include a screw, a bolt, a nail, a washer, a clasp, a magnet, an adhesive, and any combination thereof, but is not limited thereto.

Each of the plurality of set fasteners 1124 may be removably inserted through at least one of the plurality of set fastener receiving apertures 1123 to connect to the fastener receiving apertures 1117*a* of the plurality of weld studs 1117.

The plurality of wood fastener receiving apertures 1125 may be disposed on at least a portion of the main surface 1121, such as along each edge and/or each corner of the main surface 1121. However, the plurality of wood fastener receiving apertures 1125 may be disposed at any feasible location.

Each of the plurality of wood fasteners 1126 may include a screw, a bolt, a nail, a washer, a clasp, a magnet, an adhesive, and any combination thereof, but is not limited thereto.

Each of the plurality of wood fasteners 1126 may be removably inserted through at least one of the plurality of wood fastener receiving apertures 1125 to connect the main surface 1121 to the exterior surface, such as the door 10.

The emergency release slot 1127 may be disposed on at least a portion of the main surface 1121. Specifically, the emergency release slot 1127 may be disposed adjacent to the indicator aperture 1122. The emergency release slot 1127 may receive a release tool 20 therein.

The sliding lock assembly 1200 may include a knob assembly 1210, a detent ball 1220, a carrier 1230, a bolt 1240, an indicator plate 1250, and a plurality of indicator plates 1260, but is not limited thereto.

Figure 3B:
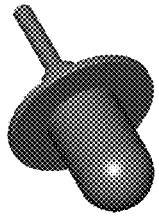
FIG. 3B illustrates a rear perspective view of the knob assembly, according to an exemplary embodiment of the present general inventive concept.
Figure 3A:
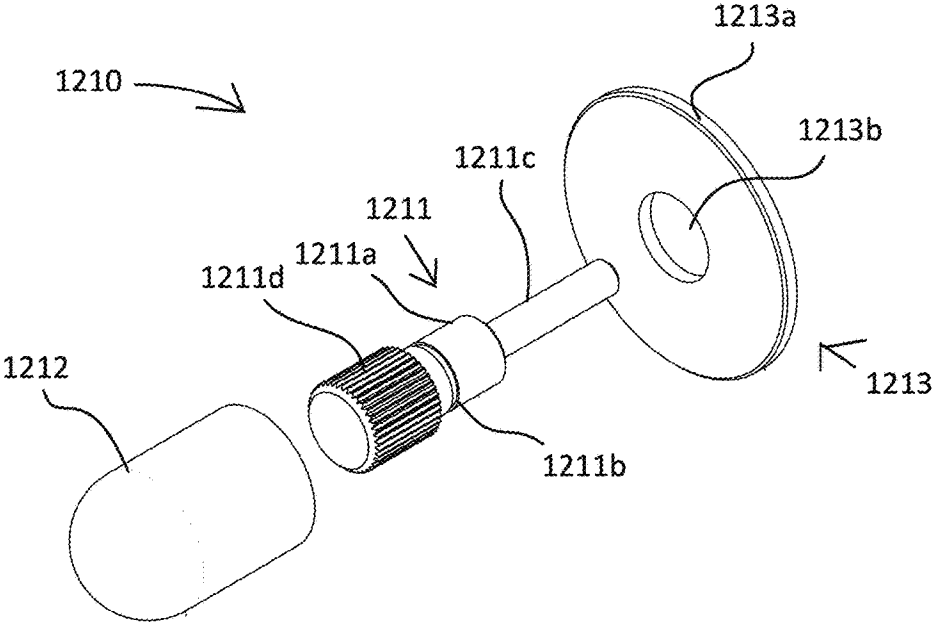
FIG. 3A illustrates an exploded view of the knob assembly, according to an exemplary embodiment of the present general inventive concept.

FIG. 3A illustrates an exploded view of the knob assembly 1210, according to an exemplary embodiment of the present general inventive concept.

FIG. 3B illustrates a rear perspective view of the knob assembly 1210, according to an exemplary embodiment of the present general inventive concept.

Figure 3C:
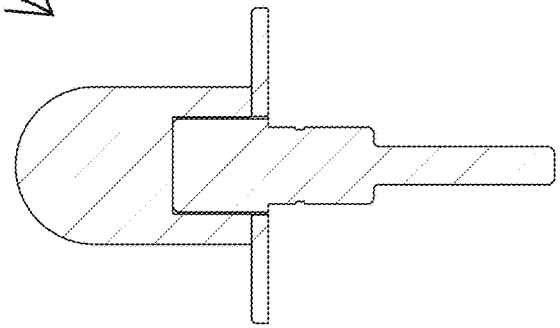
FIG. 3C illustrates a side sectional view of the knob assembly, according to an exemplary embodiment of the present general inventive concept.

FIG. 3C illustrates a side sectional view of the knob assembly 1210, according to an exemplary embodiment of the present general inventive concept.

The knob assembly 1210 may have different size (i.e. length, width, and height) based on a preference of a user and/or a manufacturer.

The knob assembly 1210 may include a main body 1211, a knob 1212, a surface cover 1213, a first shim 1214, a second shim 1215, and a retaining ring 1216, but is not limited thereto.

The main body 1211 may include a cylindrical surface 1211*a*, a ring receiving groove 1211*b*, a bolt connecting portion 1211*c*, and a knurled surface 1211*d*, but is not limited thereto.

Referring to FIG. 3A, the main body 1211 is illustrated to have a cylindrical shape. The ring receiving groove 1211*b* may be circumferentially disposed on at least a portion of the cylindrical surface 1211*a*. Moreover, the ring receiving groove 1211*b* may be recessed with respect to the cylindrical surface 1211*a*.

The bolt connecting portion 1211*c* may be disposed on at least a portion of a first end of the cylindrical surface 1211*a*. Also, the bolt connecting portion 1211*c* may extend away from the cylindrical surface 1211*a*.

The knurled surface 1211*d* may be disposed on at least a portion of a second end of the cylindrical surface 1211*a*. Additionally, the knurled surface 1211*d* may be knurled (i.e. textured) to facilitate gripping thereof.

The knob 1212 may be constructed of a plastic, metal, and/or rubber, but is not limited thereto.

The knob 1212 may be removably connected to the knurled surface 1211*d*, such that the knurled surface 1211*d* is covered. In other words, the knurled surface 1211*d* may receive the knob 1212 thereon. Furthermore, the knurled surface 1211*d* may prevent the knob 1212 from moving (i.e. sliding) off therefrom due to increasing friction to the knob 1212. Also, the knob 1212 may facilitate gripping thereof, such that the knob assembly 1210 may be moved.

The surface cover 1213 may include a body 1213*a* and a center aperture 1213*b*, but is not limited thereto.

Referring to FIG. 3A, the body 1213*a* is illustrated to have a circular shape. However, the body 1213*a* may be rectangular, triangular, pentagonal, hexagonal, heptagonal, octagonal, and any other shape known to one of ordinary skill in the art. Also, the body 1213*a* may be removably connected to the main body 1211.

The center aperture 1213*b* may be disposed on at least a portion of a center of the body 1213*a*. The center aperture 1213*b* may receive the main body 1211 therethrough.

The first shim 1214 may include a first body 1214*a* and a first aperture 1214*b*, but is not limited thereto.

Referring to FIG. 2C, the first body 1214*a* is illustrated to have a circular shape. However, the first body 1214*a* may be rectangular, triangular, pentagonal, hexagonal, heptagonal, octagonal, and any other shape known to one of ordinary skill in the art.

The first aperture 1214*b* may be disposed on at least a portion of a center of the first body 1214*a*. The first aperture 1214*b* may receive the main body 1211 therethrough, such that the first body 1214*a* may be connected to the surface cover 1213.

Also, the first shim 1214 may facilitate movement of the main body 1211 and/or the surface cover 1213 against the lateral surface 1111.

The second shim 1215 may include a second body 1215*a* and a second aperture 1215*b*, but is not limited thereto.

Referring again to FIG. 2C, the second body 1215*a* is illustrated to have a circular shape. However, the second body 1215*a* may be rectangular, triangular, pentagonal, hexagonal, heptagonal, octagonal, and any other shape known to one of ordinary skill in the art.

The second aperture 1215*b* may be disposed on at least a portion of a center of the second body 1215*a*. The second aperture 1215*b* may receive the main body 1211 therethrough.

The retaining ring 1216 may include a ring body 1216*a*, a ring aperture 1216*b*, and a ring gap 1216*c*, but is not limited thereto.

Referring again to FIG. 2C, the ring body 1216*a* is illustrated to have a circular shape. However, the ring body 1216*a* may be rectangular, triangular, pentagonal, hexagonal, heptagonal, octagonal, and any other shape known to one of ordinary skill in the art.

The ring aperture 1216*b* may be disposed on at least a portion of a center of the ring body 1216*a*. The ring aperture 1216*b* may receive the main body 1211 therethrough, such that the ring body 1216*a* may be connected to the second shim 1215.

The ring gap 1216*c* may be disposed on at least a portion of the ring body 1216*a*. More specifically, the ring gap 1216*c* may separate a first end of the ring body 1216*a* from a second end, such that the ring body 1216*a* is not a contiguous structure.

Furthermore, the bolt connecting portion 1211*c* may be inserted through the lock receiving aperture 1114 to receive the second shim 1215 and/or the retaining ring 1216 thereon. As such, the knob assembly 1210 may removably connect to the lateral surface 1111 via the lock receiving aperture 1114.

Also, the second shim 1215 may facilitate movement of the retaining ring 1216 against the lateral surface 1111. Furthermore, the retaining ring 1216 may be removably connected to the ring receiving groove 1211*b*, such that the retaining ring 1216 may prevent the main body 1211 from moving away from the lateral surface 1111.

Accordingly, the knob assembly 1210 may move laterally from a first position (i.e. left) to at least partially toward a second position (i.e. right) in response to a force applied thereto (e.g., pushed and/or pulled by the user). Alternatively, the knob assembly 1210 may move laterally from the second position to at least partially toward the first position.

The knob assembly 1210 may receive the limb of the user thereon. For example, the knob assembly 1210 may receive the arm, the wrist, the elbow, the shoulder, the leg, and/or the knee of the user therein. As such, the knob assembly 1210 may facilitate gripping thereof, such that the hands of the user are not needed.

Figure 4:
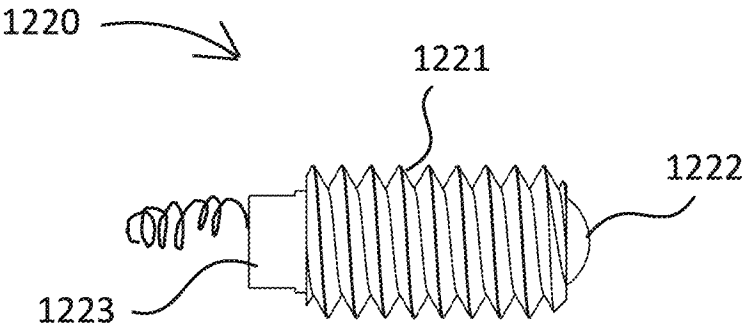
FIG. 4 illustrates a side elevation view of a detent ball, according to an exemplary embodiment of the present general inventive concept.

FIG. 4 illustrates a side elevation view of a detent ball 1220, according to an exemplary embodiment of the present general inventive concept.

The detent ball 1220 may include a threaded portion 1221, a rounded surface 1222, and a smooth portion 1223, but is not limited thereto.

The rounded surface 1222 may be disposed at a first end of the threaded portion 1221. The smooth portion 1223 may be disposed at a second end of the threaded portion 1221. The threaded portion 1221 may be connected to a threaded surface to be connected thereto.

Moreover, the rounded surface 1222 may prevent movement of the knob assembly 1210 in response to being moved to the first position and/or the second position. More specifically, the rounded surface 1222 may increase resistance (i.e. friction) to movement in response to contacting another surface. A spring connected to the rounded surface 1222 and/or the lateral surface 1111 may provide pressure thereto, such that the rounded surface 1222 applies pressure to the another surface.

In other words, the detent ball 1220 may temporarily keep the knob assembly 1210 in a fixed position by applying pressure against the another surface.

Figure 5A:
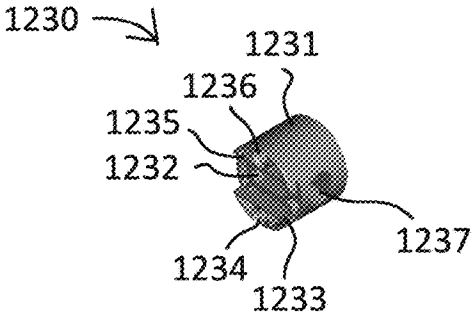
FIG. 5A illustrates a front perspective view of a carrier, according to an exemplary embodiment of the present general inventive concept.

FIG. 5A illustrates a front perspective view of a carrier 1230, according to an exemplary embodiment of the present general inventive concept.

Figure 5B:
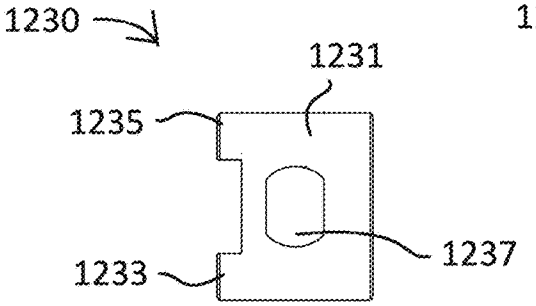
FIG. 5B illustrates a left side elevation view of the carrier, according to an exemplary embodiment of the present general inventive concept.

FIG. 5B illustrates a left side elevation view of the carrier 1230, according to an exemplary embodiment of the present general inventive concept.

Figure 5C:
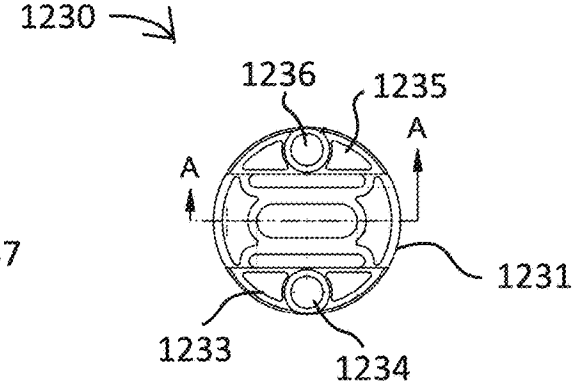
FIG. 5C illustrates a front elevation view of the carrier, according to an exemplary embodiment of the present general inventive concept.

FIG. 5C illustrates a front elevation view of the carrier 1230, according to an exemplary embodiment of the present general inventive concept.

Figure 5D:
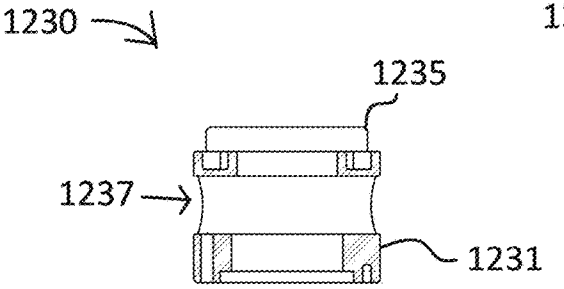
FIG. 5D illustrates a sectional view of the carrier taken along A-A of FIG. 5C, according to an exemplary embodiment of the present general inventive concept.

FIG. 5D illustrates a sectional view of the carrier 1230 taken along A-A of FIG. 5C, according to an exemplary embodiment of the present general inventive concept.

Figure 5E:
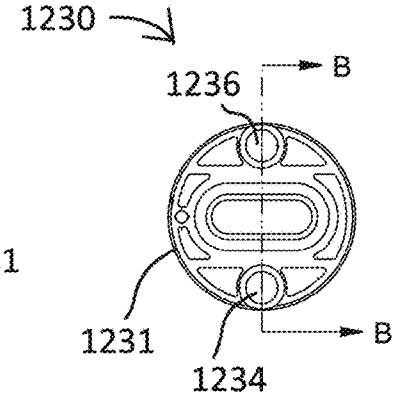
FIG. 5E illustrates a rear elevation view of the carrier, according to an exemplary embodiment of the present general inventive concept.

FIG. 5E illustrates a rear elevation view of the carrier 1230, according to an exemplary embodiment of the present general inventive concept.

Figure 5F:
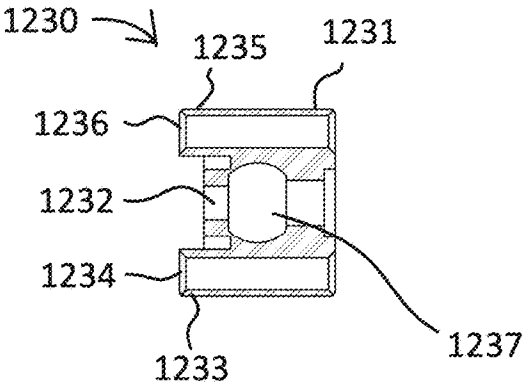
FIG. 5F illustrates a sectional view of the carrier taken along B-B of FIG. 5E, according to an exemplary embodiment of the present general inventive concept.

FIG. 5F illustrates a sectional view of the carrier 1230 taken along B-B of FIG. 5E, according to an exemplary embodiment of the present general inventive concept.

The carrier 1230 may include a body 1231, a lock connecting aperture 1232, a first elevated portion 1233, a first stud receiving aperture 1234, a second elevated portion 1235, a second stud receiving aperture 1236, and a bolt receiving aperture 1237, but is not limited thereto.

The body 1231 may have a cylindrical shape. However, the body 1231 may be rectangular, triangular, pentagonal, hexagonal, heptagonal, octagonal, and any other shape known to one of ordinary skill in the art. Also, the body 1231 may have different size based on a preference of the user and/or the manufacturer.

Referring to FIGS. 5A, 5C, and 5E, the lock connecting aperture 1232 is illustrated to have an oval shape. However, the lock connecting aperture 1232 may be rectangular, triangular, pentagonal, hexagonal, heptagonal, octagonal, and any other shape known to one of ordinary skill in the art.

The lock connecting aperture 1232 may be disposed on and/or within at least a portion of the body 1231, such as a center of a front portion of the body 1231. The lock connecting aperture 1232 receive the main body 1211 therethrough, such that the main body 1211 may move laterally from the first position to the second position, or the second position to the first position.

The first elevated portion 1233 may be disposed on at least a portion of the front portion of the body 1231. Moreover, a length of the first elevated portion 1233 from a rear of the body 1231 to the front of the body 1231 may be greater than a length of the body 1231 at a center thereof.

The first stud receiving aperture 1234 may be disposed on at least a portion of the first elevated portion 1233. The first stud receiving aperture 1234 may receive at least one of the plurality of weld studs 1117 therein.

The second elevated portion 1235 may be disposed on at least a portion of the front portion of the body 1231. Moreover, a length of the second elevated portion 1235 from the rear of the body 1231 to the front of the body 1231 may be greater than the length of the body 1231 at the center thereof. However, the length of the first elevated portion 1233 may be equivalent to the length of the second elevated portion 1235. Furthermore, the center portion of the body 1231 may be recessed with respect to the first elevated portion 1233 and/or the second elevated portion 1235.

The second stud receiving aperture 1236 may be disposed on at least a portion of the second elevated portion 1235. The second stud receiving aperture 1236 may receive at least one of the plurality of weld studs 1117 therein.

Referring to FIGS. 5A, 5B, and 5F, the bolt receiving aperture 1237 may be disposed on and/or within at least a portion of the center of the body, such as through a side of the body 1231 different from the front portion and/or the rear of the body 1231.

Figure 6B:
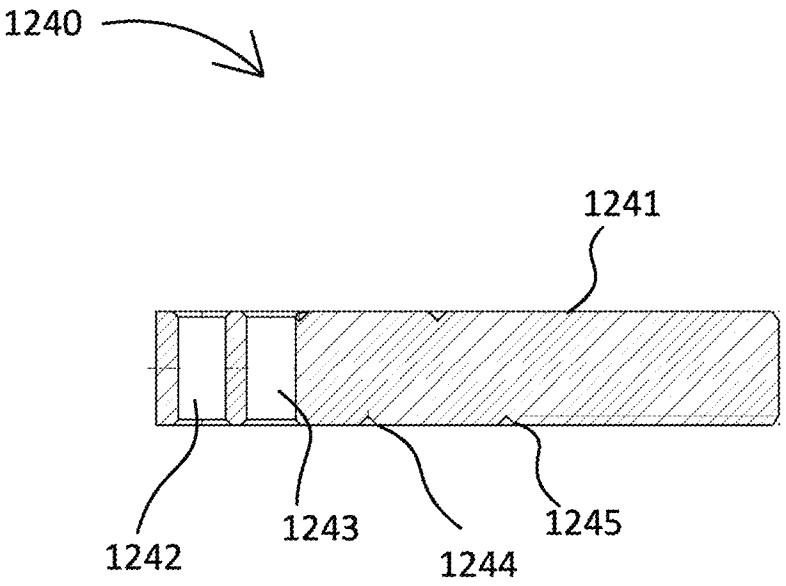
FIG. 6B illustrates a sectional view of the bolt taken along B-B of FIG. 6A, according to an exemplary embodiment of the present general inventive concept.
Figure 6A:
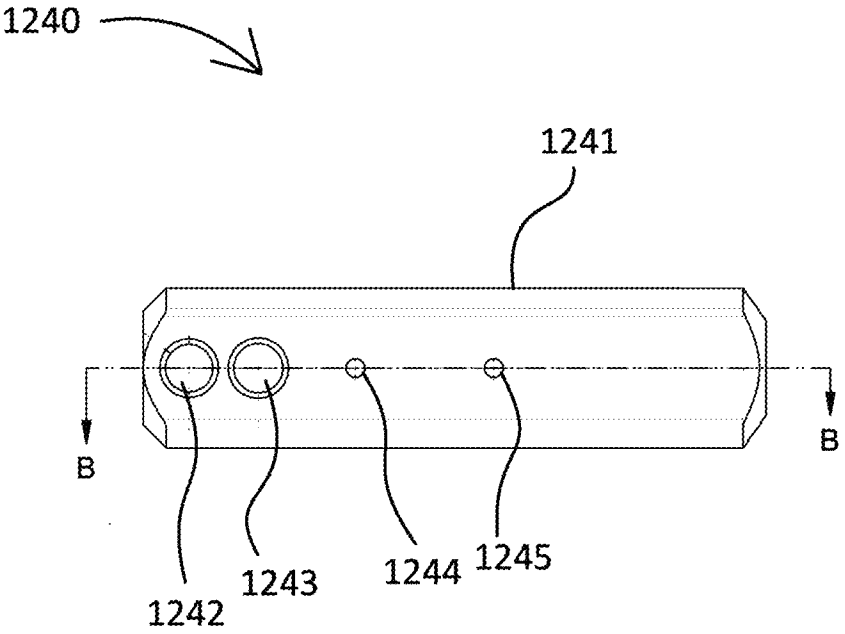
FIG. 6A illustrates a front view of a bolt, according to an exemplary embodiment of the present general inventive concept.

FIG. 6A illustrates a front view of a bolt 1240, according to an exemplary embodiment of the present general inventive concept.

FIG. 6B illustrates a sectional view of the bolt 1240 taken along B-B of FIG. 6A, according to an exemplary embodiment of the present general inventive concept.

The bolt 1240 may include a body 1241, a first knob receiving aperture 1242, a second knob receiving aperture 1243, a first detent ball aperture 1244, and a second detent ball aperture 1245, but is not limited thereto.

The body 1241 may have a predetermined size (i.e. length, width, and height). Also, the body 1241 may be removably connected within (i.e. slidably connected) the bolt receiving aperture 1237. In other words, the bolt receiving aperture 1237 may receive the body 1241 therein. Also, the body 1241 may move within the bolt receiving aperture 1237.

The first knob receiving aperture 1242 may be disposed on at least a portion of the body 1241. The first knob receiving aperture 1242 may receive the main body 1211 therein.

The second knob receiving aperture 1243 may be disposed on at least a portion of the body 1241. The second knob receiving aperture 1243 may receive the main body 1211 therein. In other words, the bolt connecting portion 1211*c* of the main body 1211 may be removably inserted into the first knob receiving aperture 1242 and/or the second knob receiving aperture 1243. However, the first knob receiving aperture 1242 may be located in a different position with respect to the second knob receiving aperture 1243.

The body 1241 may move in response to movement of the knob assembly 1210. Also, the main body 1211 may be positioned differently on the body 1241 via the first knob receiving aperture 1242 and/or the second knob receiving aperture 1243, such that the body 1241 may extend differently from the carrier 1230. Accordingly, the body 1241 may move laterally from the first position (i.e. unlocked, within the carrier 1230) to at least partially toward the second position (i.e. locked, extended from the carrier 1230) in response to movement of the knob assembly 1210.

In other words, the body 1241 may move from retracted within the carrier 1230 to at least partially extended from the carrier 1230 in response to moving the knob assembly 1210 toward the second position, and move from extended to at least partially retracted within the carrier 1230 in response to moving the knob assembly 1210 toward the first position.

Also, the detent ball 1220 may be connected (i.e. via the spring) to at least a portion of the body 1231 of the carrier 1230.

The first detent ball aperture 1244 may be disposed on at least a portion of the body 1241. The first detent ball aperture 1244 may receive the rounded surface 1222 of the detent ball 1220 therein. As such, the detent ball 1220 may increase resistance to movement by the body 1241 in the first position.

The second detent ball aperture 1245 may be disposed on at least a portion of the body 1241. Also, the second detent ball aperture 1245 may be located differently from the first detent ball aperture 1244. The second detent ball aperture 1245 may receive the rounded surface 1222 of the detent ball 1220 therein. As such, the detent ball 1220 may increase resistance to movement by the body 1241 in the second position.

Figure 7A:
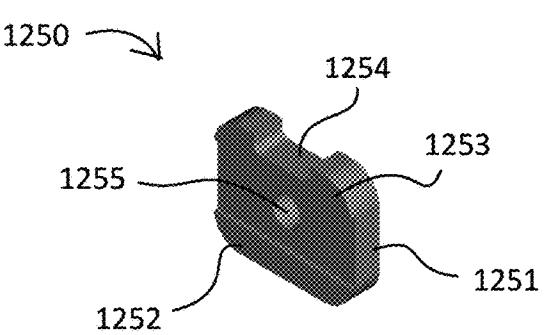
FIG. 7A illustrates a front perspective view of an indicator plate, according to an exemplary embodiment of the present general inventive concept.

FIG. 7A illustrates a front perspective view of an indicator plate 1250, according to an exemplary embodiment of the present general inventive concept.

Figure 7B:
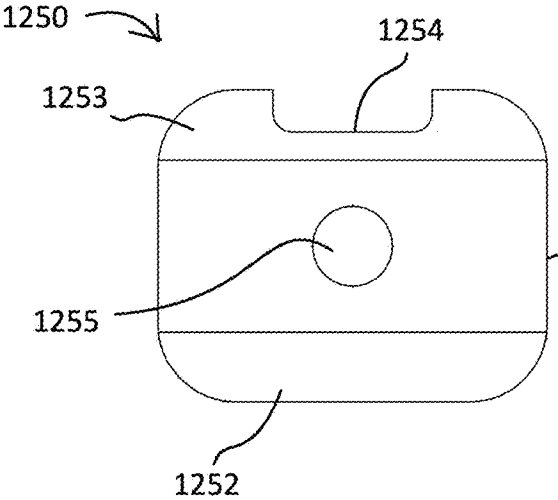
FIG. 7B illustrates a front elevation view of the indicator plate, according to an exemplary embodiment of the present general inventive concept.

FIG. 7B illustrates a front elevation view of the indicator plate 1250, according to an exemplary embodiment of the present general inventive concept.

Figure 7C:
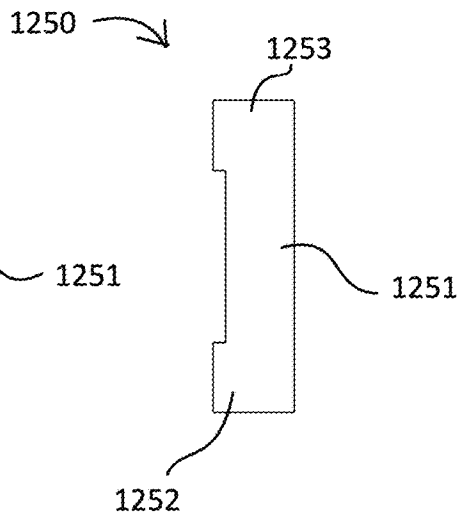
FIG. 7C illustrates a left side elevation view of the indicator plate, according to an exemplary embodiment of the present general inventive concept.

FIG. 7C illustrates a left side elevation view of the indicator plate 1250, according to an exemplary embodiment of the present general inventive concept.

Figure 7D:
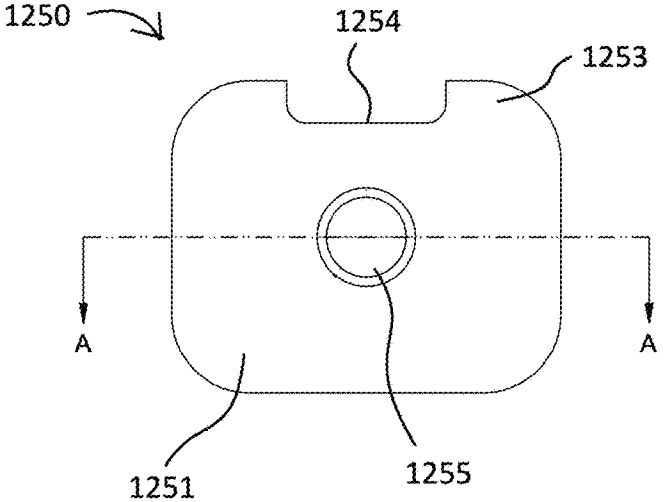
FIG. 7D illustrates a rear elevation view of the indicator plate, according to an exemplary embodiment of the present general inventive concept.

FIG. 7D illustrates a rear elevation view of the indicator plate 1250, according to an exemplary embodiment of the present general inventive concept.

Figure 7E:
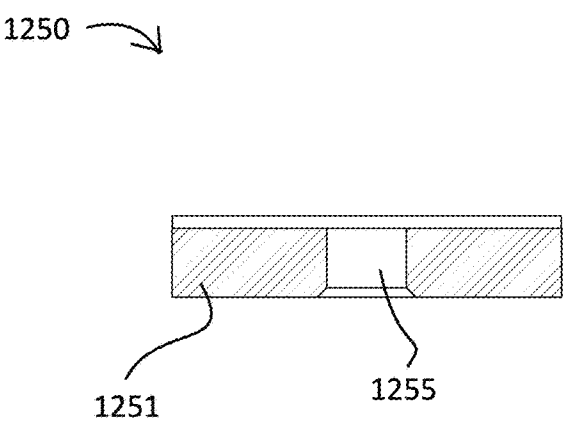
FIG. 7E illustrates a sectional view of the indicator plate taken along A-A of FIG. 7D, according to an exemplary embodiment of the present general inventive concept.

FIG. 7E illustrates a sectional view of the indicator plate 1250 taken along A-A of FIG. 7D, according to an exemplary embodiment of the present general inventive concept.

The indicator plate 1250 may include a body 1251, a first elevated portion 1252, a second elevated portion 1253, an indented portion 1254, and a knob receiving aperture 1255, but is not limited thereto.

The body 1251 may have a predetermined size (i.e. length, width, and height).

The first elevated portion 1252 may be disposed on at least a portion of a front portion of the body 1251. Moreover, a length of the first elevated portion 1252 from a rear of the body 1251 to the front of the body 1251 may be greater than a length of the body 1251 at a center thereof.

The second elevated portion 1253 may be disposed on at least a portion of the front portion of the body 1251. Moreover, a length of the second elevated portion 1253 from the rear of the body 1251 to the front of the body 1251 may be greater than the length of the body 1251 at the center thereof. However, the length of the first elevated portion 1252 may be equivalent to the length of the second elevated portion 1253. Furthermore, the center portion of the body 1251 may be recessed with respect to the first elevated portion 1252 and/or the second elevated portion 1253.

The indented portion 1254 may be disposed on at least a portion of the second elevated portion 1253. Additionally, the indented portion 1254 may be recessed with respect to an edge of the second elevated portion 1253.

Also, the indented portion 1254 may align with the emergency release slot 1127 to allow the release tool 20 to connect to the bolt 1240. As such, the bolt 1240 may move to the first position and/or the second position in response to movement of the release tool 20. In other words, the emergency release slot 1127 may facilitate unlocking the knob assembly 1210 from the locked position, using the release tool 20 to move the bolt 1240.

The knob receiving aperture 1255 may be disposed on at and/or within at least a portion of a center of the body 1251. The knob receiving aperture 1255 may receive the bolt connecting portion 1211*c* of the main body 1211 therethrough.

The plurality of indicators 1260 may include a substrate adhesive, a magnetic surface, and a substrate with an etched design, but is not limited thereto.

The plurality of indicators 1260 may be removably connected to the body 1251 of the indicator plate 1250, such as between the first elevated portion 1252 and/or the second elevated portion 1253. In other words, the body 1251 may receive the plurality of indicators 1260 thereon. Moreover, the plurality of indicators 1260 may indicate a current position of the knob assembly 1210. More specifically, the plurality of indicators 1260 may indicate the first position (i.e. unlocked) and/or the second position (i.e. locked) of the knob assembly 1210.

Furthermore, the plurality of indicators 1260 may be displayed through the indicator aperture 1122 of the exterior plate 1120. In other words, the plurality of indicators 1260 may be viewed through the indicator aperture 1122 by the user. As such, the current position of the knob assembly 1210 may be determined.

Figure 8B:
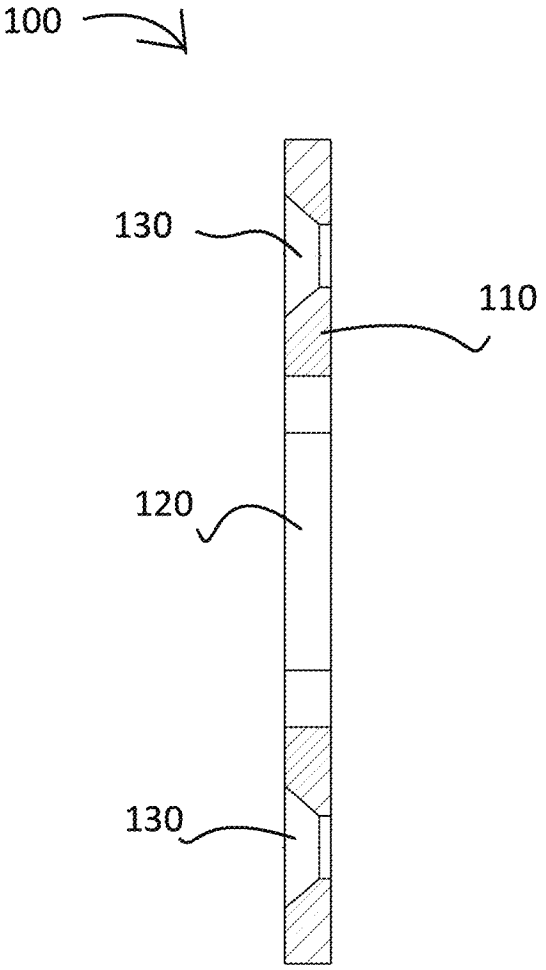
FIG. 8B illustrates a sectional view of the latch face taken along A-A of FIG. 8A, according to an exemplary embodiment of the present general inventive concept.
Figure 8A:
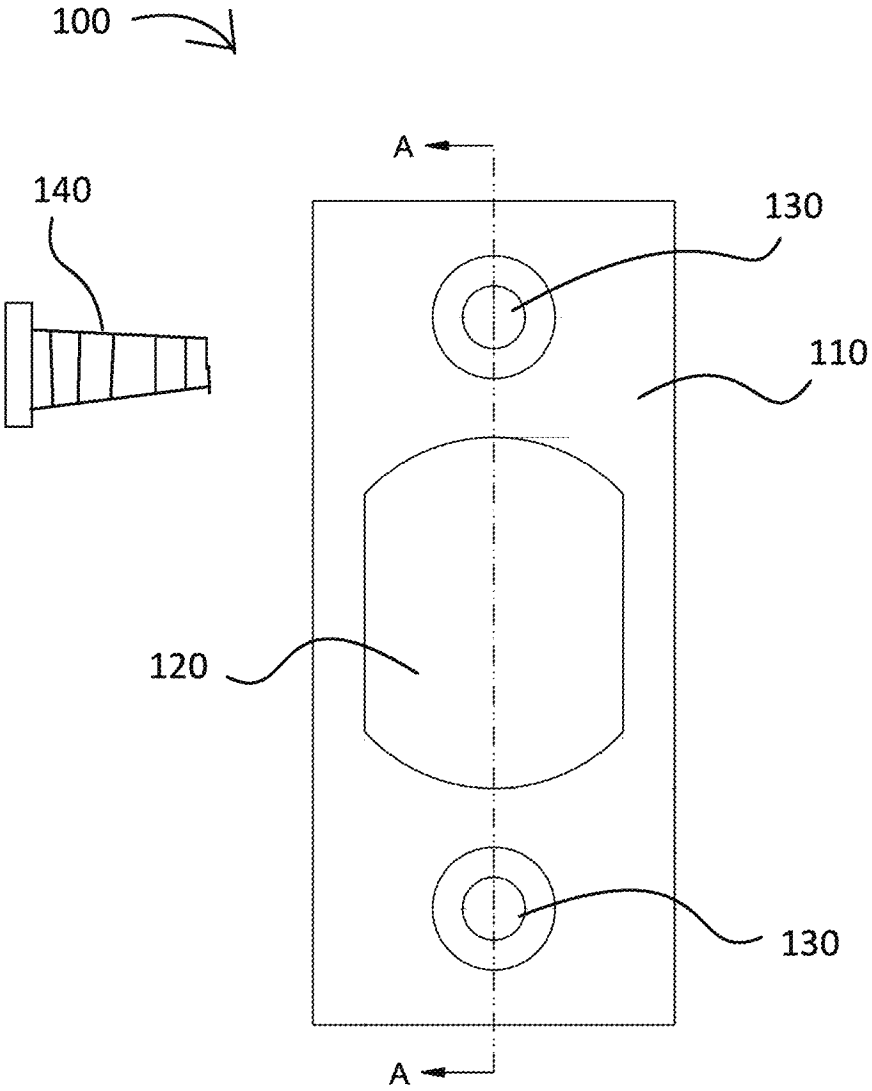
FIG. 8A illustrates a front elevation view of a latch face, according to an exemplary embodiment of the present general inventive concept.

FIG. 8A illustrates a front elevation view of a latch face 100, according to an exemplary embodiment of the present general inventive concept.

FIG. 8B illustrates a sectional view of the latch face 100 taken along A-A of FIG. 8A, according to an exemplary embodiment of the present general inventive concept.

The latch face 100 may include a latch body 110, a bolt receiving aperture 120, a plurality of fastener receiving apertures 130, and a plurality of fasteners 140, but is not limited thereto.

The latch body 110 may be removably connected to an external surface, such as an edge of the door 10.

The bolt receiving aperture 120 may be disposed on and/or within at least a portion of the latch body 110, such as a center of the latch body 110. The bolt receiving aperture 120 may receive the bolt 1240 therethrough. More specifically, the bolt receiving aperture 120 may receive the bolt 1240 extending therethrough in the second position.

The plurality of fastener receiving apertures 130 may be disposed on and/or within at least a portion of the latch body 110.

Each of the plurality of fasteners 140 may include a screw, a bolt, a nail, a washer, a clasp, a magnet, an adhesive, and any combination thereof, but is not limited thereto.

Each of the plurality of fasteners 140 may be removably inserted through at least one of the plurality of fastener receiving apertures 130 to connect the latch body 110 to the edge of the door 10.

Figure 9:
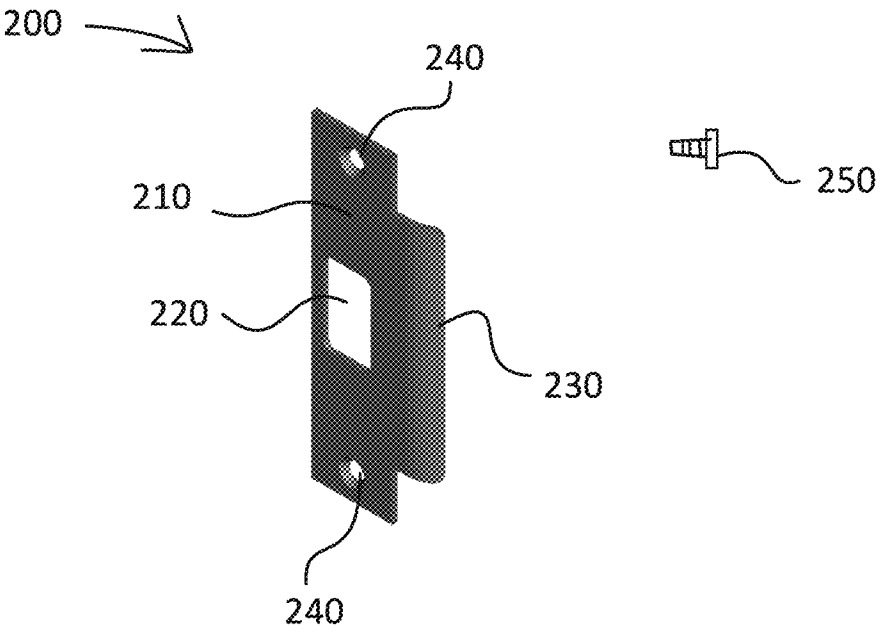
FIG. 9 illustrates a front perspective view of a strike plate, according to an exemplary embodiment of the present general inventive concept.

FIG. 9 illustrates a front perspective view of a strike plate 200, according to an exemplary embodiment of the present general inventive concept.

The strike plate 200 may include a strike body 210, a bolt receiving aperture 220, a bent portion 230, a plurality of fastener receiving apertures 240, and a plurality of fasteners 250, but is not limited thereto.

The strike body 210 may be removably connected to an external surface, such as a lock jamb of the door 10.

The bolt receiving aperture 220 may be disposed on and/or within at least a portion of the strike body 210, such as a center of the strike body 210. The bolt receiving aperture 220 may receive the bolt 1240 therethrough. More specifically, the bolt receiving aperture 220 may receive the bolt 1240 therein in response to moving the bolt 1240 in the second position.

The bent portion 230 may be disposed on at least a portion of the strike body 210, such as an edge of the strike body 210. The bent portion 230 may prevent damage to the lock jamb of the door 10 in response to contact from the bolt 1240.

The plurality of fastener receiving apertures 240 may be disposed on and/or within at least a portion of the strike body 210.

Each of the plurality of fasteners 250 may include a screw, a bolt, a nail, a washer, a clasp, a magnet, an adhesive, and any combination thereof, but is not limited thereto.

Each of the plurality of fasteners 250 may be removably inserted through at least one of the plurality of fastener receiving apertures 240 to connect the strike body 210 to the lock jamb of the door 10.

Therefore, the arm-receiving door handle and sliding lock system 1000 may facilitate opening and/or closing the door 10 without using the hands of the user. Also, the arm-receiving door handle and sliding lock system 1000 may facilitate locking and/or unlocking the door without using the hands of the user.

The present general inventive concept may include an arm-receiving door handle and sliding lock system 1000, including an arm-receiving door handle assembly 1100, including an interior plate 1110 removably connected to at least a portion of an inner surface of a door 10 to receive a limb of a user thereon, and an exterior plate 1120 removably connected to at least a portion of an exterior surface of the door 10, and a sliding lock assembly 1200, including a knob assembly 1210 removably connected to the interior plate 1110 to move laterally from unlocked in a first position to at least partially locked in a second position, and from locked in the second position to at least partially unlocked in the first position, a carrier 1230 connected to the knob assembly 1210, and a bolt 1240 removably connected within at least a portion of the carrier 1230 to move from retracted within the carrier 1230 to at least partially extended from the carrier 1230 in response to moving the knob assembly 1210 toward the second position, and move from extended to at least partially retracted within the carrier 1230 in response to moving the knob assembly 1210 toward the first position.

The interior plate 1110 may include a lateral surface 1111, a first curved portion 1112 arcuately disposed away from a first end of the lateral surface 1111 with respect to a direction to facilitate gripping thereof, and a second curved portion 1113 arcuately disposed away from a second end of the lateral surface 1111 with respect to the direction to facilitate gripping thereof.

The first curved portion 1112 and the second curved portion 1113 may curve toward a center of the lateral surface 1111.

The interior plate 1110 may include a lock receiving aperture 1114 disposed on at least a portion of the interior plate 1110 to receive the knob assembly 1210 therethrough.

The knob assembly 1210 may include a main body 1211, a knob 1212 disposed on at least a portion of the main body 1211 to facilitate gripping thereof, a surface cover 1213 connected to the main body 1211 to receive the main body 1211 therethrough, a first shim 1214 connected to the surface cover 1213 to facilitate movement of the main body 1211 and the surface cover 1213 against the interior plate 1110, a second shim 1215 connected to the interior plate 1110 to receive the main body 1211 therethrough, and a retaining ring 1216 removably connected to the main body 1211 to prevent the main body 1211 from moving away from the interior plate 1110.

The carrier 1230 may include a body 1231, a lock connecting aperture 1232 disposed on and within at least a portion of a center portion of the body 1231 to receive the knob assembly 1210 therethrough, a first elevated portion 1233 disposed on at least a portion of a front portion of the body 1231, a second elevated portion 1235 disposed on at least a portion of the front portion of the body 1231, such that the center portion of the body 1231 is recessed with respect to the first elevated portion 1233 and the second elevated portion 1235, and a bolt receiving aperture 1237 disposed on and within at least a portion of the body 1231 to receive the bolt 1240 therein.

The bolt 1240 may include a body 1241, at least one knob receiving aperture disposed on at least a portion of the body 1241 to receive the knob assembly 1210 therein, and at least one detent ball aperture disposed on at least a portion of the body 1241.

The arm-receiving door handle and sliding lock system 1000 may further include a detent ball 1220 connected to at least a portion of the carrier 1230 and the at least one detent ball aperture to increase resistance to movement of the knob assembly 1210 in at least one of the first position and the second position.

The arm-receiving door handle and sliding lock system 1000 may further include an indicator plate 1250 to receive a plurality of indicators 1260 thereon to indicate at least one of the first position and the second position of the knob assembly 1210.

The exterior plate 1120 may include a main surface 1121, and an indicator aperture 1122 disposed on at least a portion of the main surface 1121 to display the indicator plate 1250 therethrough.

The exterior plate 1120 may further include an emergency release slot 1127 disposed on at least a portion of the main surface 1121 to receive a release tool 20 therethrough, such that the bolt 1240 connects to the release tool 20 and moves in response to movement of the release tool 20.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An arm-receiving door handle and sliding lock system, comprising:

an arm-receiving door handle assembly, comprising:

an interior plate removably connected to at least a portion of an inner surface of a door to receive a limb of a user thereon, and an exterior plate removably connected to at least a portion of an exterior surface of the door; and a sliding lock assembly, comprising:

a knob assembly removably connected to the interior plate to move laterally from unlocked in a first position to locked in a second position, and from locked in the second position to unlocked in the first position, such that the knob assembly is inserted through the interior plate, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position.

2. The arm-receiving door handle and sliding lock system of claim 1, wherein the interior plate comprises:

a lateral surface;

a first curved portion arcuately disposed away from a first end of the lateral surface with respect to a direction to facilitate gripping thereof; and a second curved portion arcuately disposed away from a second end of the lateral surface with respect to the direction to facilitate gripping thereof.

3. The arm-receiving door handle and sliding lock system of claim 2, wherein the first curved portion and the second curved portion curve toward a center of the lateral surface.

4. The arm-receiving door handle and sliding lock system of claim 1, wherein the interior plate comprises:

a lock receiving aperture disposed on at least a portion of the interior plate to receive the knob assembly therethrough.

5. The arm-receiving door handle and sliding lock system of claim 1, wherein the knob assembly comprises:

a main body;

a knob disposed on at least a portion of the main body to facilitate gripping thereof;

a surface cover connected to the main body to receive the main body therethrough;

a first shim connected to the surface cover to facilitate movement of the main body and the surface cover against the interior plate;

a second shim connected to the interior plate to receive the main body therethrough; and a retaining ring removably connected to the main body to prevent the main body from moving away from the interior plate.

6. The arm-receiving door handle and sliding lock system of claim 1, wherein the carrier comprises:

a body;

a lock connecting aperture disposed on and within at least a portion of a center portion of the body to receive the knob assembly therethrough;

a first elevated portion disposed on at least a portion of a front portion of the body;

a second elevated portion disposed on at least a portion of the front portion of the body, such that the center portion of the body is recessed with respect to the first elevated portion and the second elevated portion; and a bolt receiving aperture disposed on and within at least a portion of the body to receive the bolt therein.

7. The arm-receiving door handle and sliding lock system of claim 1, wherein the bolt comprises:

a body;

at least one knob receiving aperture disposed on at least a portion of the body to receive the knob assembly therein; and at least one detent ball aperture disposed on at least a portion of the body.

8. The arm-receiving door handle and sliding lock system of claim 7, further comprising:

a detent ball connected to at least a portion of the carrier and the at least one detent ball aperture to increase resistance to movement of the knob assembly in at least one of the first position and the second position.

9. The arm-receiving door handle and sliding lock system of claim 1, further comprising:

an indicator plate to receive a plurality of indicators thereon to indicate at least one of the first position and the second position of the knob assembly.

10. The arm-receiving door handle and sliding lock system of claim 9, wherein the exterior plate comprises:

a main surface; and an indicator aperture disposed on at least a portion of the main surface to display the indicator plate therethrough.

11. The arm-receiving door handle and sliding lock system of claim 10, wherein the exterior plate further comprises:

an emergency release slot disposed on at least a portion of the main surface to receive a release tool therethrough, such that the bolt connects to the release tool and moves in response to movement of the release tool.

12. An arm-receiving door handle and sliding lock system, comprising:

an arm-receiving door handle assembly, comprising:

an interior plate removably connected to at least a portion of an inner surface of a door to receive a limb of a user thereon, the interior plate comprising:

a lateral surface, a first curved portion arcuately disposed away from a first end of the lateral surface with respect to a direction to facilitate gripping thereof, and a second curved portion arcuately disposed away from a second end of the lateral surface with respect to the direction to facilitate gripping thereof, and an exterior plate removably connected to at least a portion of an exterior surface of the door; and a sliding lock assembly, comprising:

a knob assembly removably connected to the interior plate to move laterally from unlocked in a first position to locked in a second position, and from locked in the second position to unlocked in the first position, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position.

13. The arm-receiving door handle and sliding lock system of claim 12, wherein the first curved portion and the second curved portion curve toward a center of the lateral surface.

14. An arm-receiving door handle and sliding lock system, comprising:

an arm-receiving door handle assembly, comprising:

an interior plate removably connected to at least a portion of an inner surface of a door to receive a limb of a user thereon, the interior plate comprising a lock receiving aperture disposed on at least a portion of the interior plate, and an exterior plate removably connected to at least a portion of an exterior surface of the door; and a sliding lock assembly, comprising:

a knob assembly removably connected to the interior plate to move laterally from unlocked in a first position to locked in a second position, and from locked in the second position to unlocked in the first position, such that the knob assembly is received through the lock receiving aperture, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position.

15. The arm-receiving door handle and sliding lock system of claim 14, wherein the knob assembly comprises:

a main body;

a knob disposed on at least a portion of the main body to facilitate gripping thereof;

a surface cover connected to the main body to receive the main body therethrough;

a first shim connected to the surface cover to facilitate movement of the main body and the surface cover against the interior plate;

a second shim connected to the interior plate to receive the main body therethrough; and a retaining ring removably connected to the main body to prevent the main body from moving away from the interior plate.

16. An arm-receiving door handle and sliding lock system, comprising:

an arm-receiving door handle assembly, comprising:

an interior plate removably connected to at least a portion of an inner surface of a door to receive a limb of a user thereon, and an exterior plate removably connected to at least a portion of an exterior surface of the door; and a sliding lock assembly, comprising:

a knob assembly removably connected to the interior plate to move laterally from unlocked in a first position to locked in a second position, and from locked in the second position to unlocked in the first position, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position, the bolt comprising:

a body, at least one knob receiving aperture disposed on at least a portion of the body to receive the knob assembly therein, and at least one detent ball aperture disposed on at least a portion of the body.

17. The arm-receiving door handle and sliding lock system of claim 16, further comprising:

a detent ball connected to at least a portion of the carrier and the at least one detent ball aperture to increase resistance to movement of the knob assembly in at least one of the first position and the second position.

18. An arm-receiving door handle and sliding lock system, comprising:

an arm-receiving door handle assembly, comprising:

an interior plate removably connected to at least a portion of an inner surface of a door to receive a limb of a user thereon, and an exterior plate removably connected to at least a portion of an exterior surface of the door;

a sliding lock assembly, comprising:

a knob assembly removably connected to the interior plate to move laterally from unlocked in a first position to locked in a second position, and from locked in the second position to unlocked in the first position, a carrier connected to the knob assembly, and a bolt removably connected within at least a portion of the carrier to move from retracted within the carrier to at least partially extended from the carrier in response to moving the knob assembly toward the second position, and move from extended to at least partially retracted within the carrier in response to moving the knob assembly toward the first position; and an indicator plate to receive a plurality of indicators thereon to indicate at least one of the first position and the second position of the knob assembly.

19. The arm-receiving door handle and sliding lock system of claim 18, wherein the exterior plate comprises:

a main surface; and an indicator aperture disposed on at least a portion of the main surface to display the indicator plate therethrough.

20. The arm-receiving door handle and sliding lock system of claim 19, wherein the exterior plate further comprises:

an emergency release slot disposed on at least a portion of the main surface to receive a release tool therethrough, such that the bolt connects to the release tool and moves in response to movement of the release tool.

* * * * *